United States Patent [19]

Kato

[11] Patent Number: 4,899,616

[45] Date of Patent: Feb. 13, 1990

[54] PRESS WITH STROKE CONTROL DEVICE

[75] Inventor: Heizaburo Kato, Shizuoka, Japan

[73] Assignee: Sankyo Manufacturing Company, Ltd., Tokyo, Japan

[21] Appl. No.: 291,162

[22] Filed: Dec. 28, 1988

[30] Foreign Application Priority Data

Dec. 29, 1987 [JP] Japan ..... 62-333166

[51] Int. Cl.[4] ..... G05G 1/00; B30B 5/00

[52] U.S. Cl. ..... 74/571 L; 74/603; 83/527; 83/530; 83/628; 100/257

[58] Field of Search ..... 100/257, 214, 282, 292; 74/571 M, 571 R, 571 L; 83/530, 527, 628

[56] References Cited

U.S. PATENT DOCUMENTS

| | | | |
|---|---|---|---|
| 1,774,245 | 8/1930 | Strout | 100/257 X |
| 1,788,071 | 1/1931 | Strout | 100/257 X |
| 2,310,209 | 2/1943 | Bousman | 74/571 L |
| 2,594,836 | 4/1952 | Wunderlich et al. | 74/571 L |
| 3,064,559 | 11/1962 | Treer | 100/292 |
| 3,600,957 | 8/1971 | Stoffel | 74/571 M X |
| 4,135,446 | 1/1979 | Bareis et al. | 83/530 X |

FOREIGN PATENT DOCUMENTS 51-12150 4/1976 Japan .

360591 4/1962 Switzerland .

*Primary Examiner*—Harvey C. Hornsby
*Assistant Examiner*—Stephen F. Gerrity
*Attorney, Agent, or Firm*—Pollock, Vande Sande & Priddy

[57] ABSTRACT

A press with a stroke control device has a drive shaft having an eccentric member mounting portion with an eccentric member thereon, the eccentric member is at an eccentricity with respect to the drive shaft and has sliding surfaces which are in sliding engagement with the eccentric mounting portion, a cross slide supporting the eccentric member, and a slide which surrounds and supports the cross slide therein, the slide being slidable while supporting the cross slide which moves laterally when the eccentric member rotates with the drive shaft. The press further has a gear shaft extending through the eccentric member mounting portion and provided with spline-type gear teeth, the gear shaft being rotatably supported by the eccentric member, and a plurality of screw rods arranged in parallel with the gear shaft and extending through the eccentric member mounting portion and being fixed to the eccentric member; and gears screwed to the screw rods and meshing with the spline type gear teeth of the gear shaft, the gears contacting the eccentric member mounting portion.

1 Claim, 2 Drawing Sheets

PRESS WITH STROKE CONTROL DEVICE

BACKGROUND OF THE INVENTION

The present invention relates to a press with a stroke control device for controlling the length of stroke of a slide incorporated in the press.

A stroke control device for a press has been known which incorporates, as disclosed in Japanese Patent Examined Publication No. 51-12150 (see related U.S. Pat. No. 3,765,266), a pair of eccentric members. More specifically, this stroke control device has an eccentric shaft portion on a drive shaft, and an eccentric sleeve rotatably mounted on the outer surface of the eccentric shaft portion for a rotation relative thereto, the eccentric sleeve having outer peripheral surface centered at an axis which is at an eccentricity from the axis of the eccentric shaft portion. The stroke control device further has a connecting rod the upper end of which rotatably fits around the eccentric sleeve, while the lower end of the connecting rod is connected to a slide of a press. In operation, the eccentric shaft portion is rotated relative to the eccentric sleeve so as to vary the amount of eccentricity and, hence, the stroke length of the slide. The stroke control device further incorporates a releasable locking mechanism which, when the press which drives the rotary shaft operates, locks the eccentric shaft portion and the eccentric sleeve against relative rotation, whereas, when the eccentricity is to be varied, unlocks them from each other so as to allow a relative rotation therebetween.

This known stroke control device, however, suffers from a disadvantages in that the construction is inevitably complicated due to the use of the releasable locking mechanism. Another problem encountered with this known stroke control device is that, since the transmission of the torque from the eccentric shaft portion to the eccentric sleeve is conducted indirectly through the above-mentioned locking mechanism, the rigidity of the path of torque transmission is undesirably reduced to impair the precision in the torque transmission. Still another problem is that the eccentricity cannot be varied linearly due to the fact that the locking mechanism which locks the eccentric shaft portion and the eccentric sleeve against relative rotation is designed to change the locking position non-linearly, i.e., in a stepped manner.

SUMMARY OF THE INVENTION

Accordingly, an object of the present invention is to provide a press which incorporates an improved stroke control device free from the above-described problems of the prior art, and which is smoothly converting the rotary motion of the drive shaft into linear reciprocatory motion of the slide.

To this end, according to the present invention, there is provided a press with a stroke control device comprising: a drive shaft adapted to be rotatingly driven and having an eccentric member mounting portion; an eccentric member fitting on the eccentric member mounting portion, the eccentric member having an outer peripheral surface which is at an eccentricity with respect to the drive shaft and sliding surfaces which are in vertical sliding engagement with both side surfaces of the eccentric mounting portion; a cross slide embracing and rotatably supporting the eccentric member; a slide having a hollow portion which surrounds the cross slide and supports the cross slide for lateral movement therein, the slide being slidable up and down while supporting the cross slide which moves laterally when the eccentric member rotates within the cross slide together with the drive shaft; a gear shaft vertically extending through the eccentric member mounting portion and provided with spline-type gear teeth on upper and lower end portions thereof, the gear shaft being rotatably supported at its upper and lower ends thereof by the eccentric member; a plurality of screw rods arranged on both sides of the gear shaft such as to extend in parallel with the gear shaft through the eccentric member mounting portion, the screw rods being fixed at their upper and lower ends to the eccentric member; and gears screwed to upper and lower end portions of the screw rods and meshing with the spline type gear teeth on the upper and lower end portions of the gear shaft, the gears contacting upper and lower end surfaces of the eccentric member mounting portion; whereby, when the gear shaft is rotated, the gears rotate to cause the screw rods to move up and down relative to the drive shaft together with the gear shaft and the eccentric member so as to cause a change in the amount of eccentricity of the eccentric member with respect to the drive shaft, thereby allowing a control of the length of stroke of the slide.

In operation, as the gear shaft is rotated while the drive shaft is fixed, the gear rotates without moving vertically so that the screw rod engaging with the gear is caused to move up and down, with the result that the eccentric member also moves up and down together with the screw rod. In consequence, the amount of eccentricity of the eccentric member with respect to the drive shaft is changed to enable the stroke length of he slide to be controlled.

When the press operates, the drive shaft is rotatingly driven so that the eccentric member rotates within the cross slide as a unit with the cross slide, thereby causing the cross slide to move laterally. In the press according to the present invention, the slide can smoothly slide up and down while receiving in the hollow portion thereof the cross slide which is being moved laterally, whereby the rotation of the drive shaft is smoothly converted into vertical movement of the slide.

The above and other objects, features and advantages of the present invention will become clear from the following description when the same is read in conjunction with the accompanying drawings.

DESCRIPTION OF THE PREFERRED EMBODIMENT

Figure 1:
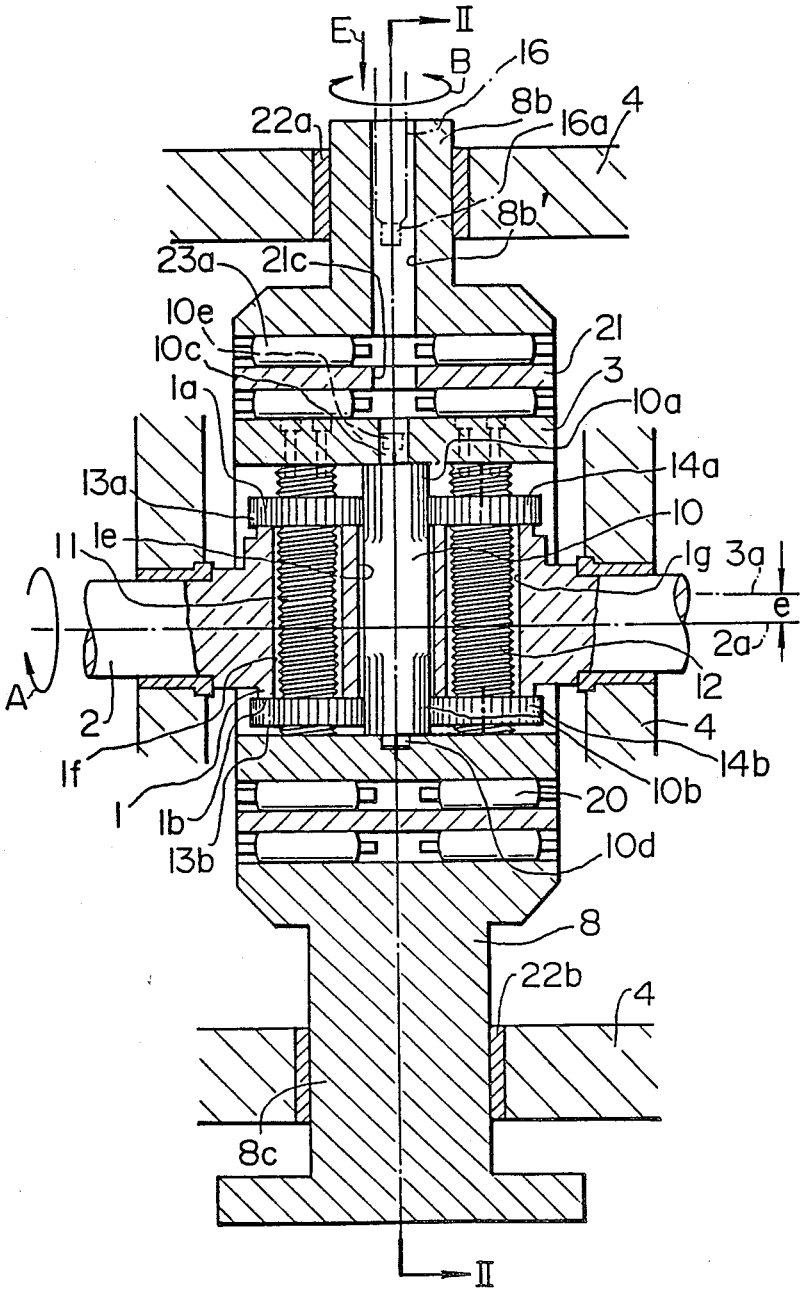
FIG. 1 is a vertical sectional view of a press incorporating a stroke control device, constructed in accordance with the present invention.
Figure 2:
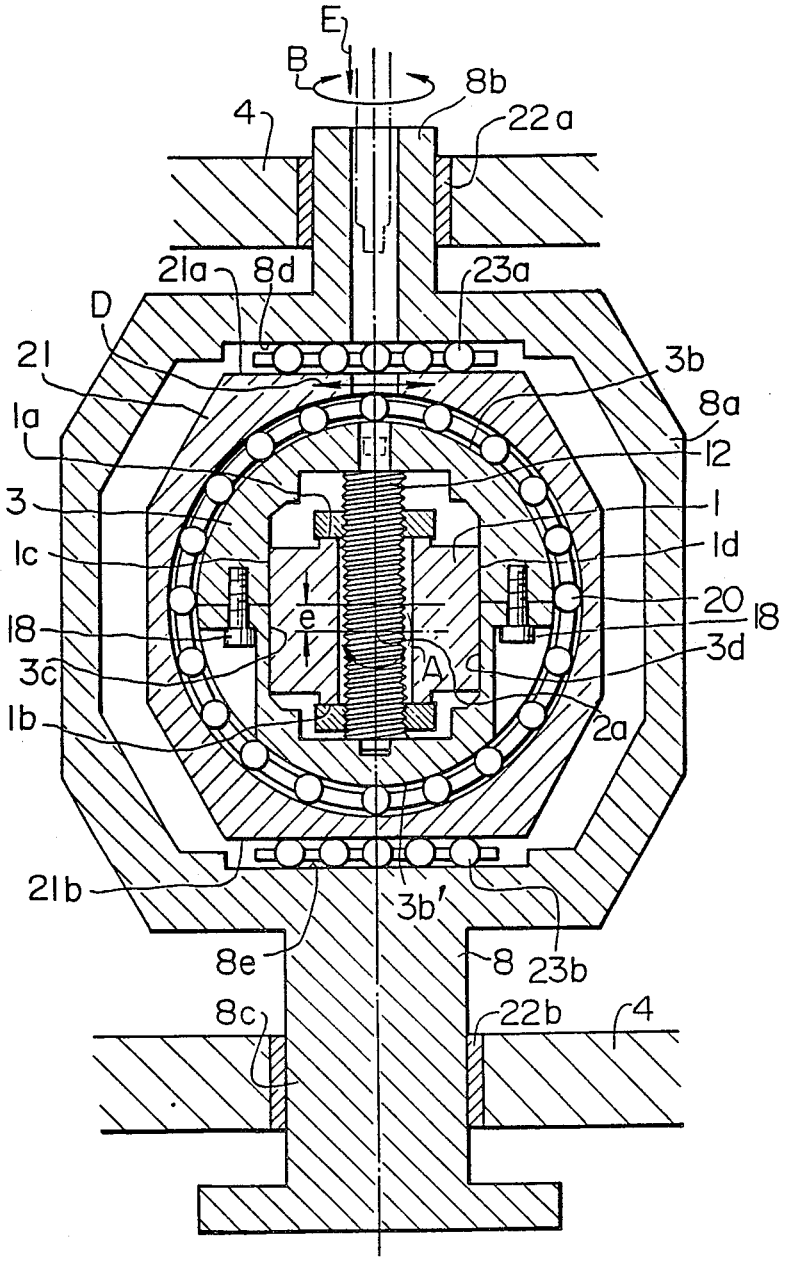
FIG. 2 is a sectional view taken along the line II—II of FIG. 1.

Referring to FIGS. 1 and 2, there is shown a press in accordance with the present invention incorporating a stroke control device. The press has a drive shaft 2 which is rotatably carried by a housing 4 and provided with an eccentric member mounting portion 1. The press also has an eccentric member 3 which fits around the eccentric member mounting portion 1 and which has outer peripheral surface portions *3b*, *3b*, located on a circle centered at an axis *3a* which is at an eccentricity e from the axis *2a* of the drive shaft 2. The eccentric member mounting portion 1 has flat parallel upper and lower end surfaces 1*a* and 1*b*, as well as flat and parallel side surfaces 1*c* and 1*d*, thus exhibiting a substantially rectangular cross-section. The side surfaces 1*c* and 1*d* of the eccentric member mounting portion 1 slidingly engage with inner surfaces 3*c* and 3*d* of the eccentric member 1.

As will be seen from FIG. 2, the eccentric member 3 is composed of two parts: namely, upper half part presenting the outer peripheral surface portion 3*b* and lower half part presenting the outer peripheral surface portion 3*b*', the upper and lower half parts being assembled together and fastened to each other through bolts 18.

A cross slide 21 is mounted on the outer periphery of the eccentric member 3 through a bearing 20. The cross slide 21 is received in a hollow portion 8*a* of a slide 8. The slide 8 is vertically slidably supported at its upper and lower end portions 8*b* and 8*c* on the housing 4 through slide bearings 22*a* and 22*b*. The cross slide 21 has flat parallel upper and lower end surfaces 21*a* and 21*b* which are held on flat upper and lower inner surfaces 8*d* and 8*e* of the hollow portion 8*a* through bearings 23*a* and 23*b*, respectively, such that the cross slide 21 is laterally movable within the hollow portion 8 as indicated by a double-headed arrow D.

Through holes 1*e*, 1*f* and 1*g* are formed substantially at axially mid portion of the eccentric member mounting portion 1 and on the left and right side of the mid portion as viewed in FIG. 1, in such a manner as to extend vertically through the eccentric member mounting portion 1. These through holes 1*e*, 1*f* and 1*g* receive, respectively, a gear shaft 10, a screw rod 11 and another screw rod 12 which extend in parallel with one another. Spline-type gear teeth 10*a* and 10*b* are formed on upper and lower portions of the gear shaft 10. The gear shaft 3 is rotatably supported at its upper and lower ends by the eccentric member 3. A recess 10*e* of a non-circular cross-section is formed on the end surface of the upper end 10*c* of the screw shaft 10 so as to be engaged by the end 16*a* of a suitable tool 16 which can be inserted to reach this recess 10*e* through continuous holes 8*b*' and 21*c* which are formed in the upper portion 8*b* of the slide 8 and in the cross slide 21. The screw rods 11 and 12 are fixed to the eccentric member 3 at their upper and lower ends. Gears 13*a*, 14*a* and gears 13*b*, 14*b* are screwed to upper and lower portions of the screw rods 11 and 12. The upper gears 13*a*, 14*a* and lower gears 13*b*, 14*b* mesh with the upper and lower gear teeth 10*a* and 10*b*. The lower end surfaces 13*a*, 14*a* of the gear 13*a* contact the upper end surface 1*a* of the eccentric member mounting portion 1, while the upper end surfaces of the gears 13*b*, 14*b* contact the lower end surface 1*b* of the eccentric member mounting portion 1*b*.

In operation, as the drive shaft 2 rotates about its axis 2*a* as indicated by an arrow A, the eccentric member 3 also rotates about the axis 2*a* as a unit with the drive shaft 2.

Since the outer peripheral surface portions 3*b* and 3*b*' are at an offset with respect to the axis 2*a*, the rotation of the eccentric member 3 causes the cross slide 21 to move laterally along the upper and lower inner surfaces 8*d* and 8*e* of the hollow portion 8*a*, through the aid of the bearings 23*a* and 23*b*, so that the slide 8 slides up and down while allowing the cross slide 21 to move laterally in the hollow portion 8*a* as indicated by the arrow D.

In consequence, a press work is effected on a material which is placed between a lower die disposed under the slide 8 and an upper die which is secured to the underside of the slide 8. The length of stroke of the sliding motion of the slide is twice as large as the above-mentioned eccentricity e.

When it is desired to change the length of stroke of the slide 8, the operator inserts a tool 16 through the holes 4*a*, 5*a* and 6*a* to bring the end 16*a* of the tool 16 into engagement with the recess 10*e* in the end surface of the gear shaft 10 and rotates the gear shaft 10 as indicated by an arrow B while fixing the drive shaft 2 against rotation. The rotation of the gear shaft 10 causes the gears 13*a*, 13*b*, 14*a* and 14*b* to rotate so that the screw rods 11 and 12 meshing with these gears are moved up and down with the result that the gear shaft 10 and the eccentric member 3 are moved up and down together with the screw rods. Consequently, the amount e of eccentricity of the eccentric member 3 is changed with respect to the drive shaft 2, thus enabling a control of the length of stroke of the slide 8.

As will be understood from the foregoing description, in the press of the present invention, the transmission of the torque from the drive shaft to the eccentric member is made directly through the engagement between both side surfaces of the eccentric member mounting portion of the drive shaft and the sliding surfaces of the eccentric member. In consequence, the construction of the press control device is simplified and the rigidity of the path of transmission of the torque is increased to enhance the precision of transmission of the torque. In addition, the stroke of the slide can be controlled linearly, simply by rotating the gear shaft. Furthermore, the amount of eccentricity, i.e., the stroke of the slide, can be indicated in terms of angle or amount of rotation of the gear shaft with the aid of a suitable gradation, because the eccentricity e varies in proportion to the angle or amount of rotation of the gear shaft. It is also to be noted that the cross slide laterally movably received in the hollow portion of the slide and the slide vertically slidably mounted on the housing are so related to each other that they can smoothly convert the rotation of the drive shaft into reciprocal linear motion, whereby the press can operate smoothly with high levels of smoothness and precision.

What is claimed is:

1. A press with a stroke control device comprising:

a drive shaft adapted to be rotatingly driven and having an eccentric member mounting portion;

an eccentric member fitting on said eccentric member mounting portion, said eccentric member having an outer peripheral surface which is at an eccentricity with respect to said drive shaft and sliding surfaces which are in vertical sliding engagement with both side surfaces of said eccentric mounting portion;

a cross slide embracing and rotatably supporting said eccentric member;

a slide having a hollow portion which surrounds said cross slide and supports said cross slide for lateral movement therein, said slide being slidable up and down while supporting said cross slide which moves laterally when said eccentric member rotates within said cross slide together with said drive shaft;

a gear shaft vertically extending through said eccentric member mounting portion and provided with spline-type gear teeth on upper and lower end portions thereof, said gear shaft being rotatably supported at its upper and lower ends thereof by said eccentric member;

a plurality of screw rods arranged on both sides of said gear shaft such as to extend in parallel with said gear shaft through said eccentric member mounting portion, said screw rods being fixed at their upper and lower ends to said eccentric member; and gears screwed to upper and lower end portions of said screw rods and meshing with said spline type gear teeth on the upper and lower end portions of said gear shaft, said gears contacting upper and lower end surfaces of said eccentric member mounting portion;

whereby, when said gear shaft is rotated, said gears rotate to cause said screw rods to move up and down relative to said drive shaft together with said gear shaft and said eccentric member so as to cause a change in the amount of eccentricity of said eccentric member with respect to said drive shaft, thereby allowing a control of the length of stroke of said slide.

* * * * *